United States Patent [19]

Elsas et al.

[11] 4,375,175

[45] Mar. 1, 1983

[54] TOWEL CUTTING MACHINE

[75] Inventors: Norman E. Elsas, Atlanta; James B. Middleton, Decatur, both of Ga.

[73] Assignee: Nemo Industries, Inc., Atlanta, Ga.

[21] Appl. No.: 266,800

[22] Filed: May 26, 1981

[51] Int. Cl.[3] ..... B26D 5/20; D06H 7/02

[52] U.S. Cl. ..... 83/18; 83/34; 83/42; 83/175; 83/206; 83/208; 83/209; 83/216; 83/277; 83/282; 83/364; 83/367; 83/368

[58] Field of Search ..... 83/18, 34, 42, 175, 83/206, 208, 209, 216, 277, 282, 364, 367, 368

[56] References Cited

U.S. PATENT DOCUMENTS

| | | | |
|---|---|---|---|
| 2,966,086 | 12/1960 | Sjöstrom | 83/368 X |
| 3,318,179 | 5/1967 | Elsas | 83/249 |
| 3,620,114 | 11/1971 | Chudyk | 83/216 X |
| 3,659,795 | 5/1972 | Bachi et al. | 83/216 X |

*Primary Examiner*—Frank T. Yost

*Attorney, Agent, or Firm*—James B. Middleton

[57] ABSTRACT

A method and apparatus for automatically severing individual towels from a length of material comprising a plurality of terry towels. The method includes the steps of measuring slightly less than the supposed length of a towel, then activating a sensor that detects the edge of a cutting space by the change in thickness of the material. The sensor causes feeding of the material to stop with a cut-line at a cutting blade. The first edge of the material is held while a second sensor located the same edge at the opposite side of the material, and the cutting blade is moved with the sensor. The material is stretched to straighten the cut-line, and the cutting blade is caused to cut the material. The apparatus includes feed rolls to move the material, and an encoder measures the length. A roller at one edge of the material detects the change in thickness at one edge, and similar rollers detect the change in thickness at the opposite edge. The sensors are mounted on a single bracket that is pivoted at one sensor; and, the cutting blade is mounted to pivot and remain parallel to a line through the two sensors.

11 Claims, 7 Drawing Figures

TOWEL CUTTING MACHINE

FIELD OF THE INVENTION

This invention relates generally to textile cutting apparatus, and is more particularly concerned with an automatic cutting machine for cutting individual towels from a roll of towelling.

BACKGROUND OF THE INVENTION

There have been many forms of automated cutting machinery in the textile industry, different forms of machines being arranged to cut on signals from different conditions in, or characteristics of, the fabric to be cut. Some apparatus has been provided for reading a very loosely woven portion with electric eyes or the like as a means for determining where to cut, printed patterns have been read through means of reflected light, and special threads have been woven into fabric to be readable by various apparatus. In general, if the fabric to be cut does not have some such special feature to be read by a piece of machinery, the fabric has to be cut purely on the basis of length, or the fabric has to be cut by hand, an inspector determining the cut-line on the basis of a visual inspection of the goods.

In the manufacture of terry towelling, the individual towels are woven in a single long piece that is wound into a roll, and the individual towels must be subsequently severed for appropriate hemming as completed towels. It is conventional in the manufacture of terry towelling to weave the body of the towel of terry cloth, and to have one or more decorative stripes of a non-terry weave at each end of each towel. Between each pair of contiguous towels there is a cutting space of a non-terry weave. The usual method is to cut the strip of towelling transversely, along the centerline of the non-terry cutting space. This leaves non-terry material on each towel to provide the appropriate hem. Obviously, if the material is cut on a bias, the individual towel will have to be squared off, then hemmed, resulting in a shorter towel than is desired, and perhaps insufficient non-terry material to allow the desired hem. Further, those skilled in the art will realize that terry towelling inherently has unbalanced tensions across the width of the towelling so that both the decorative stripes and the cutting space are not straight. Thus, not only must the appropriate cutting space be located, but also the cutting space must be straightened transversely before the cut is made.

The prior art mechanized apparatus for cutting towels has taken the form of means for holding certain areas of the terry towelling in conjunction with means for gripping and moving other sections of the towelling to align the terry material transversely and achieve a straight line across the fabric. After the line has been straightened, cutting means sever the non-terry cutting space. While this device operates adequately, it is very slow, and it is very expensive both to purchase and to maintain. Also, the prior art apparatus is not well adapted to the cutting of inexpensive terry fabric in which the terry fabric is not suficiently bulky with respect to the non-terry fabric. The prior art also includes a semi-automated cutting apparatus which is disclosed in U.S. Pat. No. 3,318,179 issued on May 9, 1967, to Norman E. Elsas. This patent discloses means for measuring the length of fabric as the fabric is fed along a path; then, at the time the fabric is to be cut, holding means engage one edge of the fabric. An operator then grasps the opposite edge of the fabric, aligns a filling thread with the cutting means, and actuates the cutting means. This device is not well adapted to the automatic cutting of terry towelling because there is no means for placing the cut-line at the cutting means, and of course an operator is required for the transverse alignment and cutting.

SUMMARY OF THE INVENTION

The present invention overcomes the above mentioned and other difficulties with the prior art by providing an automatic towel cutting apparatus including means for feeding a length of towelling along a path, length measuring means for determining when the approximate towel length has been fed, and a first-edge sensing means activated by the length measuring means for sensing one side of the cutting space between two towels. When the first-edge sensing means senses one side of the cutting space, the feeding of the material is stopped and first-edge holding means engage the fabric adjacent to one end of the cutting means and generally at said first edge. Second-edge sensing means is located opposite from the first-edge sensing means. This second-edge sensing means is activated and moves to detect the same side of the cutting space but at the second edge of the material. The opposite end of the cutting means is movable with the second-edge sensing means so the cutting means remains parallel to a line drawn between the first-edge and second-edge sensing means. When the second-edge sensing means detects the side of the cutting space, fabric stretching means engage the fabric at the second edge and adjacent to the opposite end of the cutting means, and pull the fabric taut. After the fabric is taut, the cutting means is activated to sever the fabric. The entire system is then reset and another length of fabric is fed.

BRIEF DESCRIPTION OF THE DRAWINGS

These and other features and advantages of the present invention will become apparent from consideration of the following specification when taken in conjunction with the accompanying drawings in which.

DESCRIPTION OF A PREFERRED EMBODIMENT

Referring now more particularly to the drawings and to that embodiment of the invention here chosen by way of illustration, it will first be understood that the full mechanical details are not shown herein. Much of the cutting apparatus is disclosed in the above identified U.S. Pat. No. 3,318,179, and the disclosure in that patent (which will be hereinafter referred to as the Elsas patent) is incorporated herein by reference.

Figures 1, 2:
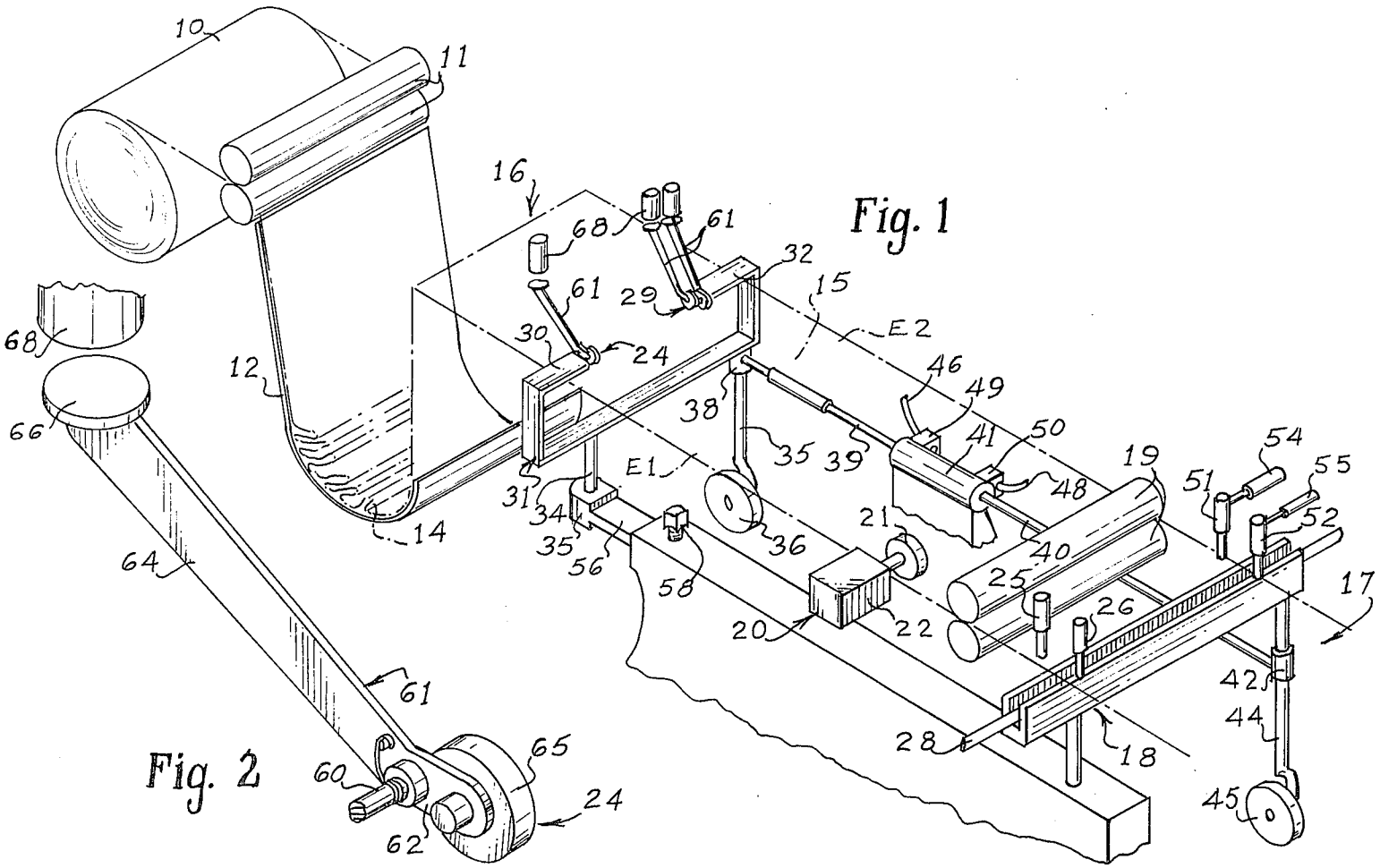
FIG. 1 is a perspective view showing apparatus embodying the present invention, with some parts being omitted for clarity, and showing the terry towel material in phantom.
FIG. 2 is an enlarged perspective view showing one form of sensing means useable in the apparatus shown in FIG. 1.

In FIG. 1 of the drawings, it will be seen that there is a supply of material designated at 10, material being fed from the supply 10 by means of feed rolls 11 into a scray 12. As is usual with such construction, the object is to accumulate a quantity of the material as at 14 so the feed rolls 11 can be driven continuously while processing of the material by the remainder of the apparatus is intermittent.

The apparatus of the present invention will include a table or other work surface over which the sheet of material 15 will slide. The table is here omitted for better illustration of the apparatus for carrying out the cutting of the material 15 and the material itself is shown in phantom, following the intended path through the apparatus. Those skilled in the art can provide suitable tables and other support means. It should be noted, however, that the path of the material 15 is somewhat inclined with the infeed end 16 slightly higher than the outfeed end 17, which is at the cutting means generally designated at 18.

To move the material 15 along the path indicated, there is a pair of feed rolls adjacent to the cutting means. The feed rolls 19 would of course have appropriate drive means, so the feed rolls 19 will pull the material 15 along the path and into the cutting zone.

As will be discussed more fully hereinafter, the present invention includes aligning the cut-line at a first edge of the material with the cutting means, then aligning the opposite end of the cutting means with the cut-line at the opposite edge of the material. Thus, the sensing operations are carried out adjacent to a first edge E1 of the material, and adjacent to a second edge E2 of the material.

It will now be seen that, adjacent to the feed rolls 19, and towards the infeed side thereof, there is a length measuring device 20. As shown, the device 20 is a conventional piece of equipment known as an encoder. The wheel 21 rides along the material 15 to drive a mechanism within the box 22. The device can be pre-set for a predetermined length, and electrical switches will be operated when the device has measured the predetermined length. Those skilled in the art will understand the device 20 and no further description will be necessary.

Since towels in a roll such as the roll 10 are not of precisely the same length, the measuring device 20 cannot be relied on to determine the exact cut-line for the towelling; however, the measuring device 20 can be set for approximately the presupposed towel length, but somewhat less, and the actual cutting space can be detected for the final measurement.

Thus, it is contemplated that the measuring device 20 will be set for a length of around three-fourths of an inch to one inch, or about 15 to 25 mm, short of the presupposed towel length. After this length has been measured, the encoder will activate the sensing means 24. It should be noted that the measuring device 20 is adjacent to the edge E1, and the sensing device 24 is adjacent to the same edge.

When the sensing device 24 is activated, it will be within the cutting space; therefore, when the sensor 24 "reads" the terry material, it will be at the side of the cutting space. At this point, the feed rolls 19 will be stopped, and the first edge holding means 25 and 26 will be activated. These holding means 25 and 26 are shown in detail in the Elsas patent, where it will be seen that there is one finger engaging the material 15 on each side of the cutting blade 28.

At this point, one towel length has been fed; and, at the edge E1, the cut-line which is the center of the cutting space is held over the cutting blade 28. There is no assurance, however, that any other part of the cut-line is aligned with the cutting blade 28.

Once the edge holding means 25 and 26 engage the edge E1, second sensing means are activated. The second sensors are located adjacent to the edge E2 and are generally designated at 29.

It will be noticed that the first sensor 24 is carried by an arm 30 which is carried by a support member 31. The member 31 is generally U-shaped and also carries the arm 32 which supports the sensors 29. The member 31 is pivotally mounted on a shaft 34 which is rotatably received in a block 35. The axis of rotation of the member 31 is aligned with the sensor 24 so that rotation of the member 31 will not change the position of the sensor 24 on the material 15.

The opposite side of the member 31 has a shaft 35, depending therefrom. The shaft 35 is here shown as having a wheel 36 on the lowermost end thereof, it being understood that the member 31 must oscillate about the shaft 34 so that the shaft 35 must move in an arcuate path. While many drag reducing arrangements may be devised, the wheel 36 is simple and will serve the purpose.

A collar 38 surrounds the shaft 35 for connection to a control rod 39, the control rod 39 being an extension of the control rod 40 which is connected to the cutting means 18.

Between the control rods 39 and 40 there is a fluid operated cylinder 41. It will therefore be seen that operation of the cylinder 41 in one direction will project the rod 39 and retract the rod 40; and, operation of the cylinder 41 in the opposite direction will retract the rod 39 and project the rod 40. Further, the rod 40 is fixed to a collar 42 on an oscillable support shaft 44 for the cutting means 18. The shaft 44 has a wheel 45 at its lower end to allow easy motion.

It will now be understood that, when the sensors 29 are activated, a signal from the sensors 29 will open the appropriate valve on the cylinder 41 and cause motion of the control rods 39 and 40. As the rod 39 moves to cause the sensors 29 to read the side of the cutting space, the rod 40 moves the end of the cutting means 18 the same amount. The result is that a line through the sensors 24 and 29 will always be parallel to the cutting blade 28.

Those skilled in the art will devise numerous fluid circuits for operation of the cylinder 41, but one very effective method of operation is to use a double ended cylinder as is shown. This cylinder has the rods 39 and 40 projecting from each end, and a single piston generally centrally of the cylinder. Air under pressure is normally supplied to both ends of the cylinder through tubes 46 and 48, resulting in balanced pressures and no motion.

When the piston is to be moved, the valve (for example) 49 is shifted to cut off the air supply through the tube 46 and vent the cylinder to the atmosphere. The low pressure on one side of the piston will therefore cause motion of the piston due to maintenance of high pressure on the other. A small orifice or an additional bleed valve may be used to vent the cylinder and slow the operation. Obviously, when the piston is to be moved in the opposite direction, the valve 50 is shifted to vent the opposite end of the cylinder to the atmosphere.

The foregoing discussion has proceeded to the point that the sensors 24 and 29 are at the side of the cutting space, and the cutting blade 28 is parallel to a line through the sensors. Now, fabric stretching means are activated to straighten the cut-line between the two points previously located.

The fabric straightening means are similar to the holding means 25 and 26, but including vertical fingers 51 and 52 for engaging the material 15, and horizontal stretching means 54 and 55. The fingers 51 and 52 are mounted for movement with the cutting means, and engage the material 15 on each side of the blade 28, then the stretching means 54 and 55 move these fingers horizontally, in a line parallel to the blade 28 to stretch the fabric 15.

Since towels are made in different lengths, and it is necessary that the distance from the sensor 24 to the cutting blade is the precise distance to be cut, the pivot shaft 34 is movable with respect to the blade pivot. As here shown, the block 35 is carried by a slide 56, the position of the slide 56 being fixable by a set screw 58. Similarly, the control rod 39 is extendable and contractable by means of telescoping sleeves as is well known in the art.

Attention is next directed to FIG. 2 of the drawings which shows one form of sensor admirably adapted for use with the apparatus of the present invention. The sensor in FIG. 2 is generally designated at 24, but it will be understood that such a sensor is also used as the sensors 29.

The sensor 24 is carried by a shaft 60, the shaft 60 being appropriately mounted on the arm 30 or 32 for proper disposition with respect to the material 15. A lever 61 is rotatably mounted on the shaft 60, the lever 61 having a sensing leg 62 and an actuating leg 64.

The sensing leg 62 is rather short, with a wheel 65 at its end. The wheel 65 will engage the material 15 and move up or down as the material 15 is thick or thin.

The actuating leg 64 is relatively long. Since the legs 62 and 64 are formed integrally, the motion of the wheel 65, hence the leg 62, will be amplified at the end of the leg 64. Though the exact relation may be varied to suit the particular engineering design, a ratio of about 1:8 has been found to be adequate with the design here presented.

The lever 61 will preferably be made of a light weight material such as aluminum or magnesium, and may be made of a plastic material. Since none of these materials is ferromagnetic, a ferromagnetic disk 66 surmounts the leg 64. Due to the presence of the ferromagnetic disk 66, a proximity sensor 68 can be utilized to detect motion of the leg 64.

While no detailed showing is here presented, those skilled in the art will understand that proximity sensors and electric switches are readily available. The sensor 68 can detect motion of a ferromagnetic member into or out of proximity therewith. In response to such motion, electric switches can be opened or closed as desired.

Thus, as here illustrated, the wheel 65, while riding over non-terry material, will be low, causing the disk to be adjacent to the sensor 68. When the wheel 65 engages terry material, the wheel 65 will rise, causing the disk 66 to lower and move away from the sensor 66.

In constructing the sensor 24, it may be necessary to use a spring means such as the spring 69 to maintain the wheel 65 in contact with the material. If such a spring is used, one must be careful not to use such pressure as will crush the terry and cause false readings.

Turning now to FIG. 3 of the drawings, the method of the present invention should be understandable.

Figure 3A:
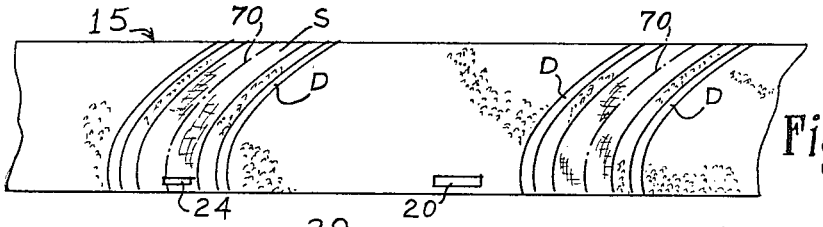
FIGS. 3*a*–3*d* are schematic illustrations showing the steps involved in the method and apparatus of the present invention; and, FIG. 4 is a block diagram showing the control sequence of the apparatus shown in FIG. 1.

FIG. 3*a* shows a length of material 15 having the first edge E1 and the second edge E2. The towels in the strip include a decorative stripe D of non-terry material, followed by a strip of terry material, then the cutting space S. After the cutting space S, there is another strip of terry material followed by another decorative stripe D of non-terry material. Thus, if the sensor 24 were always activated, there would be some difficulty in sorting out the desired strip of non-terry material. However, the measuring device 20 first measures out almost the length of a towel, then activates the sensor 24. As a result, when the sensor 24 is activated, it is within the cutting space S, and the first time the sensor 24 reads terry material, it is necessarily the side of the cutting space S.

Figure 3B:
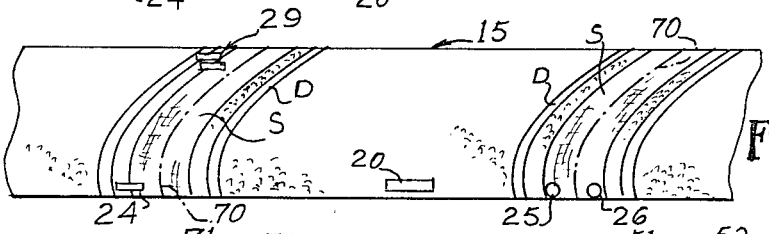

At this point, feeding of the material 15 stops and the fingers 25 and 26 engage the edge E1 of the material 15, one finger on each side of the cut-line 70 as shown in FIG. 3*b*. The edge E1 of the material is aligned for cutting, but the edge E2 may not be properly aligned, and the cutline 70 is curved and does not follow the cutting blade 28.

Figure 3C:
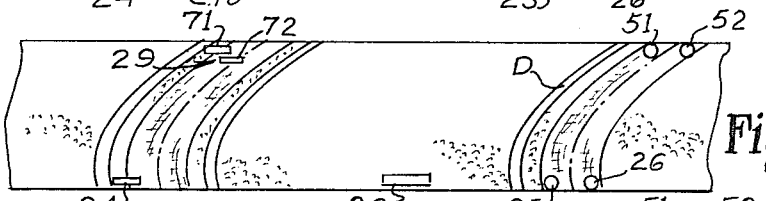

In FIG. 3*b*, the sensors 29 are shown with both sensors 71 and 72 on the terry material. This condition causes the valve 50 to be activated so the rod 39 of the cylinder 41 is retracted and the rod 40 is projected, thereby moving the sensors 29 towards the right as viewed in the drawings. This motion will continue until the sensor 72 moves into the non-terry cutting space S. When the sensor 72 moves down by falling off the terry material, switches will be operated to shift the valve 50 once again and stop the motion. This condition is shown in FIG. 3*c* of the drawings.

It will be realized that the cutting blade 28 moved while the sensors 29 moved, so the cutting blade 28 is now aligned with the cut-line 70 at both the edge E1 and the edge E2, but the cut-line is still not straight to be aligned throughout the length. Thus, the vertical holding fingers are projected to clamp the edge E2 of the fabric but the device will not yet cut.

Figure 3D:
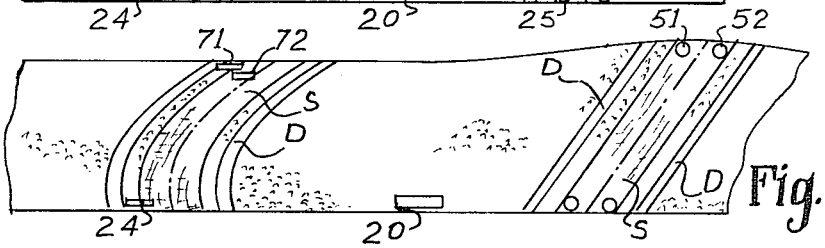

Looking finally at FIG. 3*d*, it will be seen that the cylinders 54 and 55 have been actuated to move the fingers 51 and 52. The axes of the cylinders 54 and 55 are parallel to the blade 28 so the cut-line 70 becomes straight and aligned with the cutting blade 28. The cutting can now take place.

Figure 4:
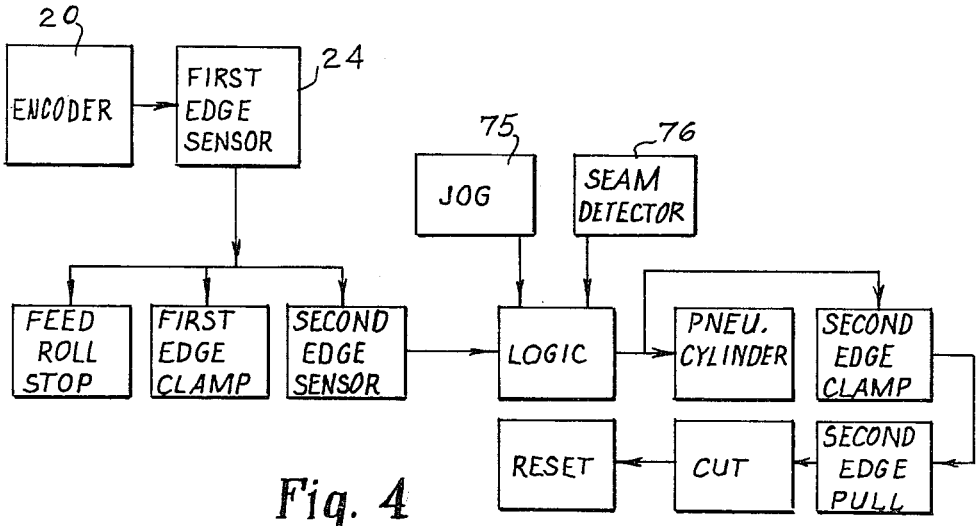

Looking now primarily at FIG. 4 of the drawings it will be understood that fabric will be fed from the roll 10 and accumulated in the scray 12. From the scray 12, the fabric will be fed past the sensors 24 and 29, and between the feed rolls 19. The apparatus must first be manually set up with the distance from the sensor 24 to the cutting blade 28 equal to one towel length. The first towel will then be fed into the apparatus, and the second sensors 29 will be set precisely at the edge of the cutting space S, using the jog switch 75 or other similar arrangement.

When the apparatus is set, the feed rolls 11 can be activated to feed material, and the feed rolls 19 also activated to carry the material through the apparatus. When the encoder 20 has measured off the predetermined length of material, which will be around an inch less than a towel length, the first edge sensor 24 will be activated, while the feed rolls 19 continue to move the fabric. When the sensor 24 reads terry material, the feed rolls 19 will be stopped and the first edge clamps 25 and 26 will engage the edge E1 to hold the cut-line 70 in place with respect to the cutting blade 28. Also, the second edge sensors 29 will be activated.

As here disclosed, the sensors 29 will be either on the terry material towards the infeed end 16, or will be on non-terry material towards the outfeed end 17. For this arrangement it is necessary only to have rather simple circuit means. It is contemplated that the switch means for one sensor 71 or 72 will be normally closed while the other is normally open. Thus, the condition of the sensors 71 and 72 is readily determined electrically for the desired motion. The condition to be achieved by the sensors would therefore be to have one switch transferred and one in its normal state.

If the material to be cut by the device has such wide variations that greater area must be traversed by the sensors 29, it is contemplated that the logic will be set so the sensors 29 move first towards the outfeed end 17, then towards the infeed end 16, the final condition being satisfied only when the sensor 71 is transferred first. This is more complex, and would be slower, but would cut accurately even with highly distorted material.

With either system, when the sensors 29 read the edge of the cutting space S, the blade 28 has been aligned with the two ends of the cut-line 70, and the second edge clamp clamps the edge E2. When the edge E2 is held, the second edge is pulled to straighten the cut-line 70; and, when the cylinders 54 and 55 have straightened the cut-line 70 the cut will be made. Following the cut, the entire apparatus will be re-set, and the feed rolls 19 will feed another length as determined by the encoder 20. The steps will be repeated through the roll to be cut.

Those skilled in the art will realize that different rolls of towels are normally sewn together to allow a continuous cutting operation, and towels may differ rather markedly from one roll to another. For this reason, the present invention may include a seam detector 76 would cause the entire apparatus to stop on detection of a seam. An operator would then place the first towel of the new roll as described in the initial set up, so the sensors 24 and 29 will be within their limits of operation.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined by the appended claims.

We claim:

1. A method for automatically cutting terry towels from a length of material including a plurality of terry towels, said length of material defining a cutting space of non-terry material between contiguous towels and defining a cut-line in the center of said cutting space, said method including the steps of aligning a first edge of said material with a cutting means so that said cut-line at said first edge is positioned to be cut by said cutting means, holding said first edge of said material adjacent to said cutting means while pivoting said cutting means at said first edge to align the opposite end of said cutting means with said cut-line at a second edge of said material, pulling said material taut to straighten said cut-line and cutting said material with said cutting means.

2. A method as claimed in claim 1, said method including the steps of feeding said material while measuring the length adjacent to said first edge of said material until a length somewhat short of a towel length has been measured, then sensing an edge of said cutting space, in order to carry out said step of aligning a first edge of said material with a cutting means.

3. A method as claimed in claim 2, and further including the steps of moving a second-edge sensor along said second edge of said material until said second-edge sensor senses said edge of said cutting space, and moving said cutting means with said second-edge sensor to carry out said step of pivoting said cutting means at said first edge to align the opposite end of said cutting means with said cut-line at a second edge of said material.

4. A method as claimed in claim 1, and further including the step of holding said second edge of said material after the step of pivoting said cutting means, and urging the holding means along a path parallel to said cutting means to accomplish the step of pulling said material taut.

5. Automatic towel cutting apparatus, for severing individual terry towels from a length of material including a plurality of terry towels, said length of material having a first edge and a second edge and defining a cutting space of non-terry material between contiguous towels and a cut-line in the center of said cutting space, said apparatus including cutting means positioned generally transversely of a path for said length of material, means for aligning a cut-line at said first edge of said material with one end of said cutting means, holding means for holding said first edge with respect to said cutting means, means for moving the opposite end of said cutting means to be aligned with said cut-line at said second edge of said length of material, and means for stretching said material along said cut-line to straighten said cut-line.

6. Automatic towel cutting apparatus as claimed in claim 5, and including feeding means for feeding material along said path, measuring means for measuring the length of material fed along said path, said measuring means being positioned to measure at said first edge, first-edge sensing means activated by said measuring means for sensing an edge of a cutting space adjacent to said first edge, said first-edge sensing means being spaced from said one end of said cutting means a distance that locates said cut-line at said one end of said cutting means when said first-edge sensing means senses said edge of a cutting space.

7. Automatic towel cutting apparatus as claimed in claim 6, and including second-edge sensing means for sensing said edge of a cutting space adjacent to said second edge, said second-edge sensing means being spaced from said opposite end of said cutting means by a distance equal to the distance between said first-edge sensing means and said one end of said cutting means, and means for moving said second-edge sensing means along said second edge.

8. Automatic towel cutting apparatus as claimed in claim 7, said means for stretching said material being mounted for movement with said opposite end of said cutting means, and including second holding means for holding said second edge adjacent to said opposite end of said cutting means, and pulling means for urging said second holding means along a line parallel to said cutting means.

9. Automatic towel cutting apparatus as claimed in claim 8, and including a pneumatic cylinder, said means for moving said second-edge sensing means comprising a first piston rod extending from said pneumatic cylinder, said means for moving the opposite end of said cutting means comprising a second piston rod extending axially of said first piston rod, air supply means for pressurizing both ends of said pneumatic cylinder, and valve means for selectively placing each end of said pneumatic cylinder at atmospheric pressure.

10. Automatic towel cutting apparatus as claimed in claim 9, and further including a bracket, said first-edge sensing means and said second-edge sensing means being carried by said bracket, said bracket being pivotally mounted on an axis extending through said first-edge sensing means so that pivotal motion of said bracket leaves said first-edge sensing means in the same position.

11. Automatic towel cutting apparatus as claimed in claim 10, said cutting means being pivotally mounted on an axis extending through said holding means at said first edge of said material so that pivotal motion of said cutting means retains alignment of said cut-line at said first edge with said one end of said cutting means.

* * * * *